US006349639B1

(12) United States Patent
Smith et al.

(10) Patent No.: US 6,349,639 B1
(45) Date of Patent: Feb. 26, 2002

(54) PAPER EMBOSSING SYSTEM WITH A FLEXIBLE COUNTER AND METHOD OF EMBOSSING

(75) Inventors: Ronald R. Smith, Kansas City, MO (US); Scott A. Schimke, Lansing, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 09/643,375

(22) Filed: Aug. 22, 2000

(51) Int. Cl.[7] ..... B31F 1/07

(52) U.S. Cl. ..... 101/32; 101/28; 101/474

(58) Field of Search ..... 101/32, 21, 3, 101/9, 114, 126, 41, 407, 493, 17, 28, 474

(56) References Cited

U.S. PATENT DOCUMENTS

| | | | | |
|---|---|---|---|---|
| 118,005 A | | 8/1871 | Foote | |
| 152,722 A | | 7/1874 | Boyce | |
| 444,835 A | | 1/1891 | Hobson | |
| 734,762 A | | 7/1903 | Smith | |
| 811,787 A | | 2/1906 | Monske | |
| 1,161,881 A | | 11/1915 | Petrelius | |
| 1,466,714 A | | 9/1923 | Harnden | |
| 1,612,841 A | | 1/1927 | Thonet | |
| 1,704,567 A | | 3/1929 | Gurnberg | |
| 1,740,399 A | | 12/1929 | Grunberg | |
| 1,856,928 A | | 5/1932 | Pannier, Jr. | |
| 2,005,340 A | | 6/1935 | Jaffin et al. | |
| 2,202,255 A | | 5/1940 | Jackson et al. | |
| 2,350,033 A | | 5/1944 | Hebenstreit | |
| 2,492,886 A | | 12/1949 | Punte | |
| 2,722,038 A | | 11/1955 | Freund | 18/48 |
| 2,748,696 A | | 6/1956 | Murray | 101/41 |
| 3,052,181 A | | 9/1962 | Typrowicz | 101/41 |
| 3,135,198 A | | 6/1964 | Kingsley | 101/407 |
| 3,243,843 A | | 4/1966 | Halpern | 18/1 |
| 3,244,093 A | | 4/1966 | Vasilantone | 101/126 |
| 3,557,277 A | | 1/1971 | Brodersen et al. | 264/316 |
| 3,568,595 A | * | 3/1971 | Bunting | 101/401.1 |
| 3,613,570 A | | 10/1971 | Gladen | 101/9 |
| 3,748,889 A | | 7/1973 | Miller et al. | 72/382 |

(List continued on next page.)

FOREIGN PATENT DOCUMENTS

| | | | |
|---|---|---|---|
| DE | 4240527 | 6/1994 | B44C/1/24 |
| EP | 0553626 | 8/1993 | B41F/5/00 |

OTHER PUBLICATIONS

PP. 287–291 from book entitled "Manufacturing Processes and Materials for Engineers", Second Edition, Lawrence E. Doyle, Prentice–Hall, Inc., Englewood Cliffs, N.J., © 1961, 1969.

Pages from the Web Site of Urethane Tooling & Engineering Corporation, Scottsdale, Arizona, dated Oct. 18, 1996.

Product Data Sheet for CC010 Countercast Tuff Film from Astor Universal, Lawrence, Kansas, dated May 22, 1996.

*Primary Examiner*—Eugene Eickholt
(74) *Attorney, Agent, or Firm*—Leydig, Voit & Mayer, Ltd.; John M. Augustyn

(57) ABSTRACT

A flexible counter for an embossing system provides resilient support under a sheet which opposes pressure from a contoured die forming an embossment in the sheet. The flexible counter includes a resilient mat and a fixed bolster which supports the mat. The bolster has peripheral walls which extend around sides of the mat so that an upper portion of the mat protrudes above the peripheral walls. In addition, the bolster includes a resilient bumper that bounds an upper portion of the mat. An upper edge of the bumper is about flush with an upper surface of the mat. The walls have a peripheral channel in which the bumper is disposed. The bumper is formed of a resilient material having higher rigidity than the mat, thereby controlling the flow and stretching behavior of the upper surface of the mat as compressed during an embossing operation.

35 Claims, 4 Drawing Sheets

U.S. PATENT DOCUMENTS

| | | | | | |
|---|---|---|---|---|---|
| 3,759,176 | A | * | 9/1973 | Schwandt | 101/150 |
| 4,058,055 | A | * | 11/1977 | Douglas | 101/27 |
| 4,455,320 | A | * | 6/1984 | Syrmis | 101/32 |
| 4,542,691 | A | | 9/1985 | Kokrhanek | 101/114 |
| 4,574,693 | A | | 3/1986 | Fink et al. | 101/3 |
| 4,655,267 | A | * | 4/1987 | Smith, Jr. et al. | 101/32 |
| 4,658,721 | A | | 4/1987 | Mathis | 101/9 |
| 4,867,057 | A | | 9/1989 | Bradley et al. | 101/21 |
| 4,928,588 | A | | 5/1990 | Mathis | 101/9 |
| 4,930,413 | A | | 6/1990 | Jaffa | 101/126 |
| 5,303,646 | A | * | 4/1994 | Melzer et al. | 101/32 |
| 5,540,153 | A | | 7/1996 | Campbell et al. | 101/493 |
| 5,671,618 | A | | 9/1997 | Bianchini | 69/48 |
| 5,713,273 | A | * | 2/1998 | Lai | 101/9 |
| 5,897,108 | A | | 4/1999 | Gordon et al. | 269/50 |
| 6,098,534 | A | * | 8/2000 | Shawahan et al. | 101/32 |
| 6,186,936 | B1 | * | 2/2001 | Smith et al. | 101/295 |

* cited by examiner

PAPER EMBOSSING SYSTEM WITH A FLEXIBLE COUNTER AND METHOD OF EMBOSSING

FIELD OF THE INVENTION

The invention relates to a system for embossing paper, such as greeting cards, and more particularly relates to an embossing system having an improved flexible counter for supporting a sheet of paper for pressing by a contoured die.

BACKGROUND

Embossing systems are used to form an embossment or decoratively raised area on a sheet of paper or cardboard. Such an embossment may serve as a decorative feature on a greeting card, business card, or the like. Conventional embossing systems include matable male and female dies contoured in the shape of the desired embossment. With a sheet (e.g., paper) disposed between the two dies, the male and female dies are pressed together in complementary engagement with each other. The paper is thereby deformed to have an embossment matching the contour of the dies.

In an embossing system with mated dies, expenses are incurred for making both the male and female dies. Additionally, such a system requires regular attention to maintain precise die alignment for repeated mating engagement.

SUMMARY OF THE INVENTION

The present invention provides improved embossing performance in a system for embossing areas on greeting card material, paper or cardboard products or other items. A flexible counter is provided to support the material being embossed by opposing pressure against a contoured die. The flexible counter has a resilient mat which resides in a fixed bolster. According to an embodiment of the invention, a resilient seal or bumper is provided peripherally around upper sides of the flexible mat to contain the counter during compression between the dies. The bumper is made of a material that is more rigid than the mat, acting to "seal" flow behavior of the softer mat during compression. In other words, the bumper limits the lateral deformation and stretching of the mat, thereby preventing tearing of the embossed paper and optimizing embossing performance.

According to one aspect of the invention, the bolster has a sidewall secured to a table around a periphery of the mat, and the bumper surrounds an upper portion of the mat, fitting between the mat and the sidewall. For example, in an embodiment, the sidewall includes a channel to accommodate the bumper. The bumper resides, in a recessed fashion, in the channel, having an inner surface supported against the mat. The mat and bumper project a distance above the sidewall.

In an embodiment, the embossing system includes one or more plate-like shim that fits on the table under the mat. Advantageously, the shim permits use of a mat having a thickness dimension less than a depth from the upper edge of the bumper to the table. This enables the mat to be made of a variety of materials which may come in various stock thicknesses, thereby reducing cost.

Various embodiments of the invention provide multiple side-by-side bolsters for simultaneously embossing multiple panels of a sheet. For example, in an embodiment, the table can accommodate the installation of respective sidewalls, mats, and bumpers in one, two, three or more panel configurations as needed to suit a particular embossing job.

In an embodiment, the bumper is unitarily formed in a rectangular shape. In another embodiment, the bumper includes a plurality of strips, each of the strips fitting along a respective side of the rectangular mat. Together, the assembled strips extend around the periphery of the upper portion of the mat.

Embodiments of the invention include additional features found to enhance performance. For example, a friction-reducing film, such as a urethane or mylar film, may be positioned over the mat to separate the mat from the sheet. The friction-reducing film reduces damage to the sheet and aids in removing the sheet from the counter after embossing. The embossing system can include a frame sized to fit externally around a periphery of the sidewalls, and at least one of the edges of the sheet are secured to the frame. In an embodiment, two opposite sides of the sheet are clipped to respective sides of the frame using U-shaped clips. The frame is preferably constructed of steel or some other relatively heavy material so that the weight of the frame holds the film taut across the mat. In an automatic sheet-feeding environment, the sheet is clipped at ends along a feeding direction of the sheets.

An advantage of the present invention is that it provides reliable embossing performance while minimizing damage to the material being embossed.

Another advantage of the present invention is that it permits embossing with only a single contoured die, eliminating a need for a mated die, reducing material expenses. The invention permits the use of either a male or female contoured die.

A related advantage of the present invention is that it eliminates a need to maintain precise die alignment, reducing maintenance effort and associated down time of the system.

A further advantage of the invention is to provide a flexible counter with improved wear characteristics.

Additional features and advantages of the invention are described in, and will be apparent from, the disclosure herein.

DESCRIPTION OF EMBODIMENTS

Figure 1:
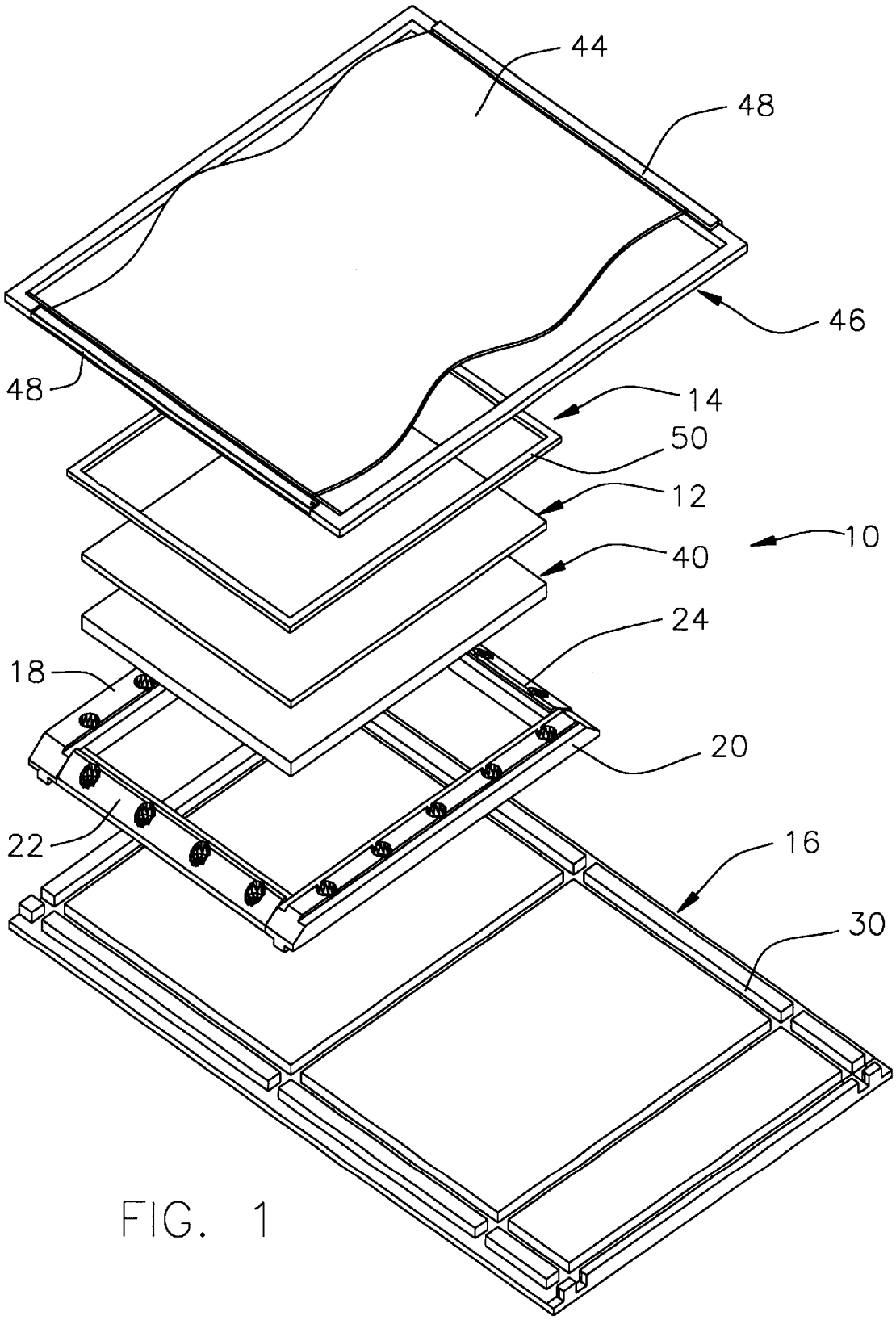
FIG. 1 is a partially exploded perspective view of a flexible counter, including a flexible mat and a bolster constructed in accordance with teachings of the invention, the bolster having a unitary bumper.

Now referring to the Figures, wherein like numerals designate like components, FIGS. 1–4 show a flexible counter 10 according to the invention. The flexible counter 10 includes a resilient mat 12, a resilient bumper 14, a rigid table 16, and a plurality of walls 18, 20, 22, 24 mounted to the table 16. The table, walls and bumper comprise a structure known as a "bolsterz" for supporting, containing and "sealing" the mat 12 during an embossing process during which the mat is compressed.

Figure 3:
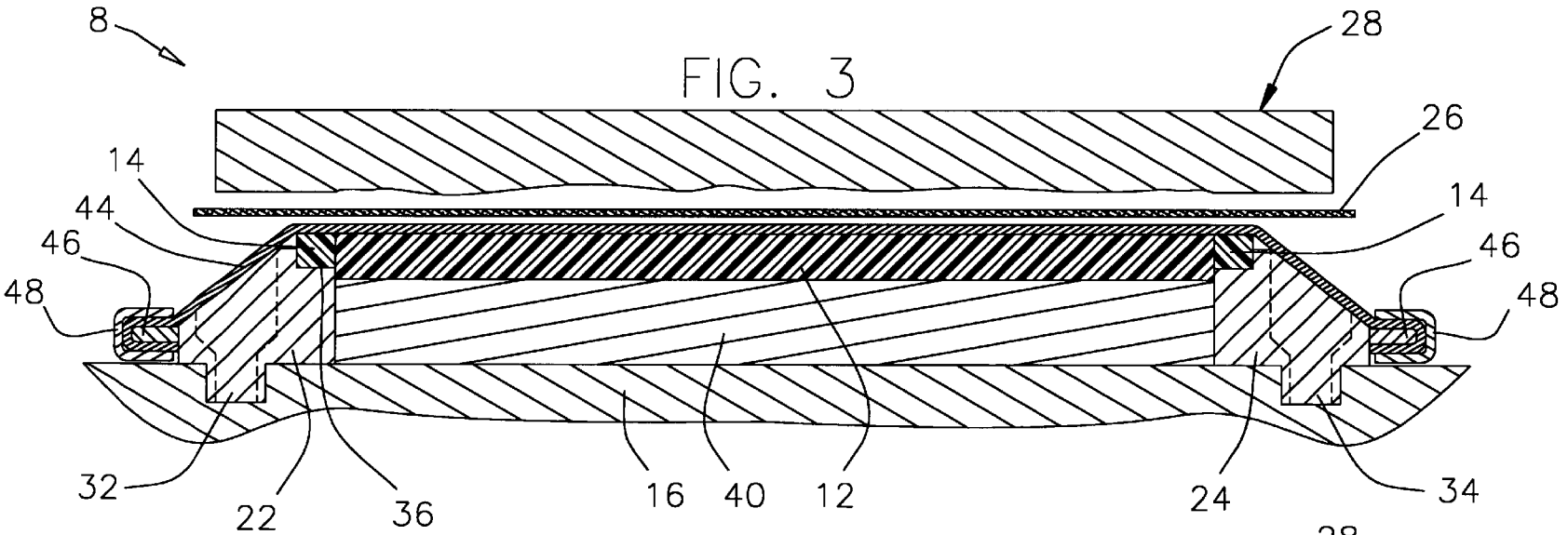
FIG. 3 is a sectional side view of a press assembly having a female die positioned above a flexible counter according to the invention.
Figure 4:
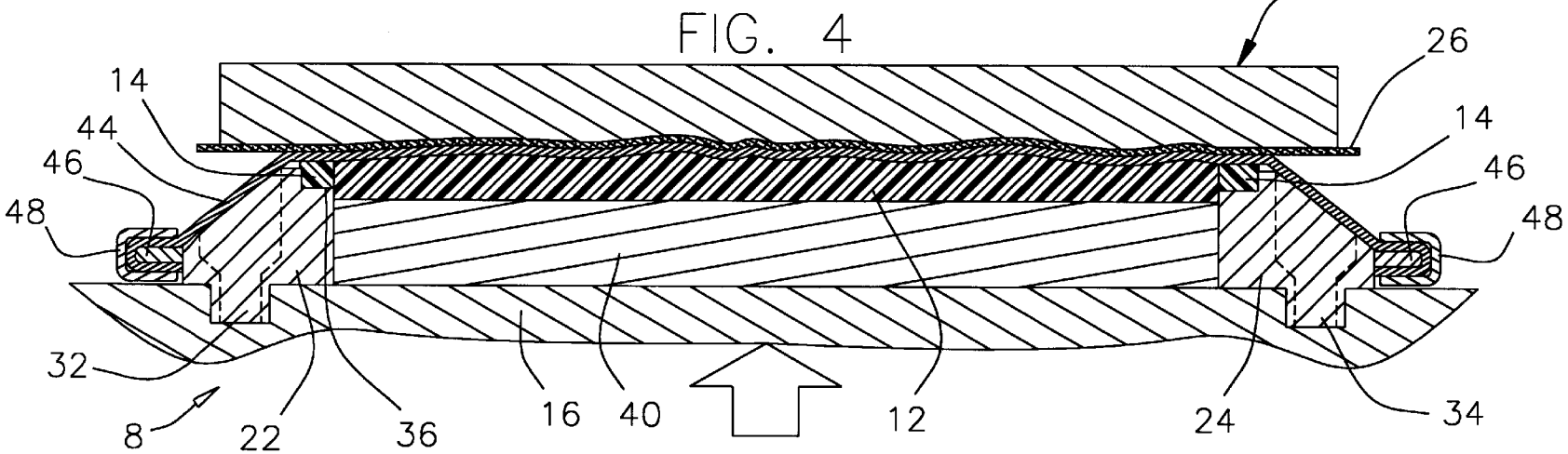
FIG. 4 is a sectional side view of the press assembly of FIG. 3 in a compressed state.

In general, the flexible counter 10 is configured to resiliently support a sheet 26 pressed against a contoured die 28 during an embossing operation, as shown in FIGS. 3 and 4. The flexible counter 10 is particularly useful in an automated embossing operation wherein embossments are formed on paper sheets during the manufacturing of greeting cards, business cards or the like.

FIG. 1 shows, in exploded view, the flexible counter 10 as configured for a single-panel embossment. It is noted, however, that the table 10 is preferably configured to accommodate the installation of additional walls to form additional counters. Such additional counters would enable the simultaneous embossing of multiple panels. For example, an embodiment with two adjacent counters could accommodate the embossing of both panels of a dual-panel, single-fold greeting card, and an embodiment with three adjacent counters could accommodate the simultaneous embossing of all panels of a three-panel, dual-fold greeting card.

In the illustrated embodiment, the table 16 has a plurality of grooves 30, and each of the side walls 18, 20 and end walls 22, 24 includes a lower projection 32, 34 (FIGS. 3 and 4) adapted to be closely received within the groove. The fit of the projections 32, 34 within the grooves 30 provides secure mounting of the walls 18, 20, 22, 24, even under high forces experienced against the mat 12 and bumper 14 during embossing. Additionally, each of the walls 18, 20, 22, 24 is provided with a plurality of bolt holes which receive respective bolts for snugly securing the respective walls to the table. In an embodiment, two or more of the plurality of walls 18, 20, 22, 24 can be an integral or unitary.

Figure 2:
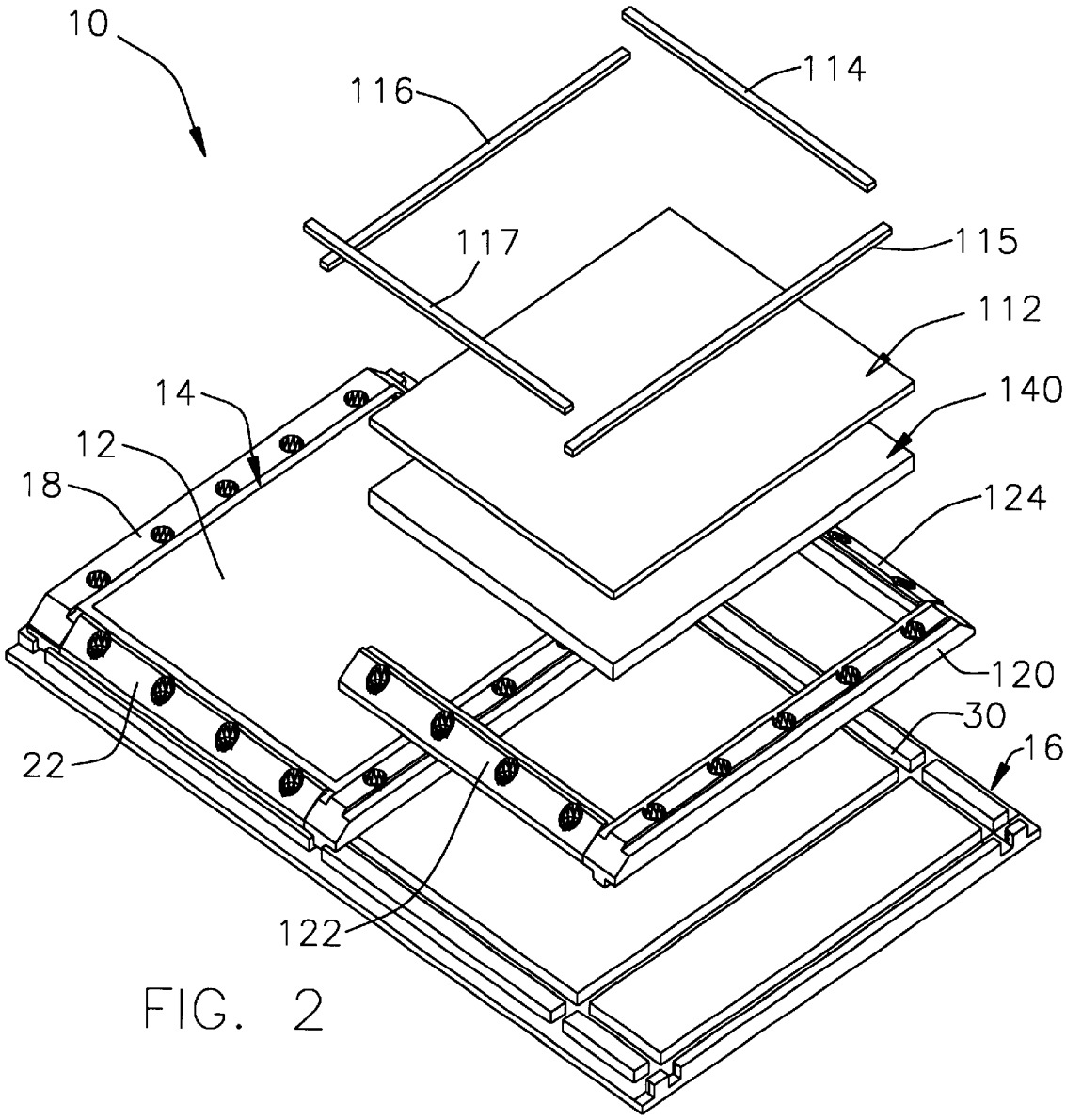
FIG. 2 is a partially exploded perspective view of a flexible counter adapted for supporting multiple panels during embossing.

Referring to FIGS. 1 and 2, to accommodate the installation of walls to provide the counter 10 with additional panels, the table includes grooves 30 positioned to mountably receive such additional walls 120, 122, 124. Within the walls 120, 122, 124 a second mat 112 is positioned to be supported by the table 16. Furthermore a second bumper 114–117 is fitted around a periphery of the mat 112.

For improving the compression behavior of the mat 12 during embossing, the bumper 14 extends around a periphery of the exposed portion of the mat 12. More specifically, the bumper 14 fits around the sides of the mat 12, between the mat 12 and the walls 18, 20, 22, 24. In the illustrated embodiment, each of the walls 18, 20, 22, 24 is shaped to have a channel 36, 38 (FIGS. 3 and 4) against which the bumper is seated. The bumper 14 is constructed of a resilient material that is more rigid than the mat 12, but not as rigid as the walls 18, 20, 22, 24, which are preferably made of steel. The bumper 14 operates to laterally contain the portion of the mat 12 which projects vertically above the walls 18, 20, 22, 24.

The bumper 14 may have one or more components. For example, the bumper 14 may be unitary, as in the rectangular embodiment illustrated in FIG. 1, or a bumper 14 may be provided of a plurality of elongate strips 114, 115, 116 and 117, as illustrated in FIG. 2.

The mat 12 fits closely within the four walls 18, 20, 22, 24 and is supported by the table 16. Depending on the thickness of the mat 12, the mat can rest directly on the table 16, or alternatively, one or more plate-like shim 40 is provided between the table 16 and the mat 12 to result in the desired positioning of the upper mat surface generally flush with the top of the bumper 14.

As shown in FIG. 3, the bumper 14 and mat 12 project above the walls 18, 20, 22, 24. Additionally, the mat 12 and bumper 14 are dimensioned so that the upper surface of the mat 12 is flush with an upper edge of the bumper 14. For example, the mat 12 protrudes above the walls 18, 20, 22, 24 by about 0.090 to 0.125 inch.

As mentioned, the desired mat level can be achieved by selecting a mat with a thickness to rest directly on the table or by selecting a mat 12 of some lesser thickness and placing one or more shim 40 (FIGS. 1, 3 and 4 ), 140 (FIG. 2) under the mat 12 to elevate the mat to the desired level. It should be noted that the mat material may be commercially available sheet form in certain stock thicknesses. The shim 40 advantageously permits the use of a mat 12 in a readily-available thickness. For example, mat material is commercially available in thicknesses of 0.25, 0.375, and 0.5 inches. It has been found that suitable behavior is achievable from a mat 12 having such thicknesses, used in conjunction with an appropriate shim 40. It is believed that other mat thicknesses would also provide suitable behavior.

The mat 12 may be made of various natural or synthetic elastomers which have appropriate resilience. For example, natural gum rubber has been found to exhibit favorable properties. Other suitable materials may include buna-n rubber, neoprene, silicon, sorbothane, EPDM rubber, urethane, cotton, reinforced neoprene and hypalon. In one embodiment, the mat would have the following characteristics:

| | First Range | Second Range | Preferred |
|---|---|---|---|
| Hardness | | | |
| (Durometer) Shore A | 30–60 | 35–45 | 40 |
| Tensile Strength (psi) | 2000–6000 | 3000–4500 | 4000 |
| Heat Stability | | | |
| Fahrenheit | −20°–300° | −20°–140° | 175° |

The bumper 14 is constructed of a material that is resilient, yet firmer and more rigid than the mat 12 material. For example, various plastic or hard rubber materials are suitable, such as urethane. It has been found that a bumper works suitably well having sides with a width within a range of about 1/10 to 3/16 in. and a height of about 0.25 in. Other sizes also work.

Figure 5:
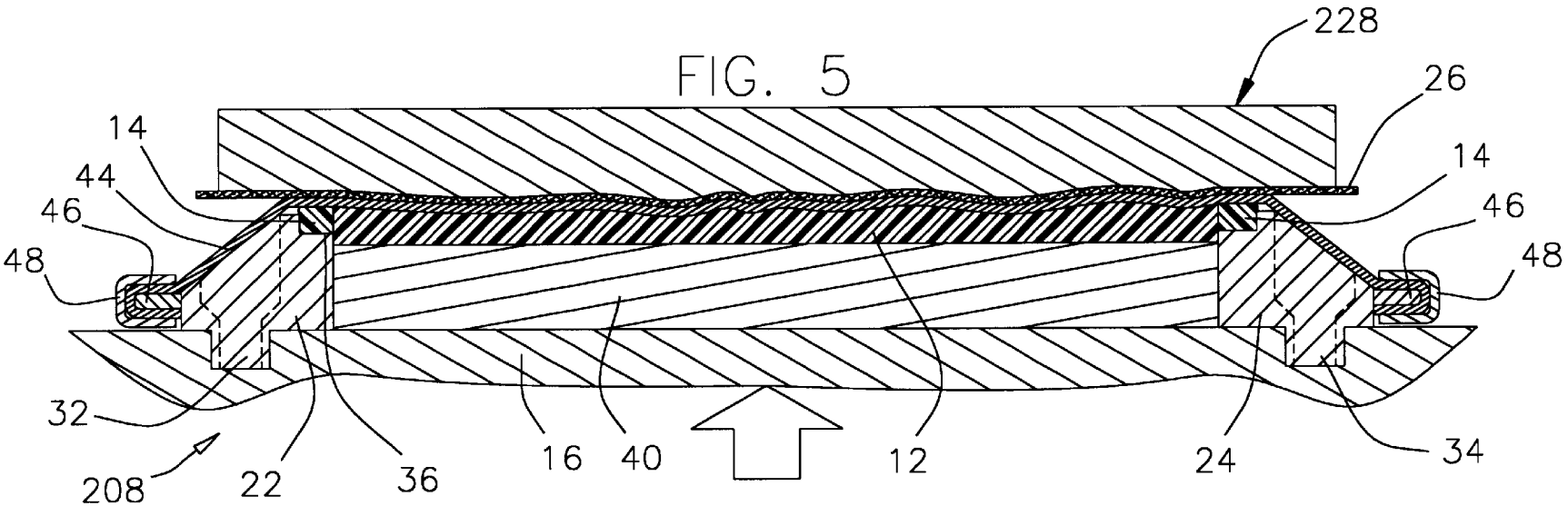
FIG. 5 is a sectional side view of a press assembly having a male die compressing the flexible counter.

Turning to FIGS. 3 and 4, the contoured die 28 is mounted to oppose the counter 10. The die 28 may have a female contour, having a recessed embossment image, as illustrated in FIGS. 3 and 4, or a die 228 may be used having a male contour as illustrated in FIG. 5. For example, a typical emboss die 28 has a contour depth of about 0.06 to 0.08 inches or protrusion of 0.03 to 0.06 inches. The sheet 26 of material to be embossed is positioned between the flexible counter 10 and the opposing die 28. Although the sheet 26 may be provided in various thickness, a standard thickness is about 0.010 inch.

For creating an embossment, the counter 10 and die 44 are movable toward each other. For example, the table is moveable upwardly (as illustrated), the die 28 is moveable downwardly, or both. A hydraulic press is typically used to drive the die 28 and counter 10 together. The counter 10 and contoured die 28 deformably press the sheet 26 to form an embossment thereon. For typical card embossing, the die compression stroke may continue beyond an initial contact between about 0.030 to 0.125 inch.

The sheet 26 may be paper, cardboard or some other deformable material suitable for embossing. The sheet 26 may be provided in precut sections or in the form of a continuous web, and may be positioned between the die 26 and flexible counter 10 by suitable automatic sheet-feeding equipment.

According to the invention, the flexible counter 10 supports the mat 12 in a controlled manner. Specifically, the mat deformation caused by pressure from the contoured die is directionally controlled, resulting in a "flow" behavior of the mat material which optimizes the embossing performance. In particular, the bumper 14 helps avoid undesirable lateral translation and stretching of the upper mat surface which reduces the risk of tearing the sheet 26.

For example, as illustrated in FIGS. 3 and 4, the flexible counter 10 is effective to support one side of the sheet 26 during an embossing operation wherein the contoured embossing die 28 presses against an opposite side of the sheet 26 toward the flexible counter 10. FIG. 3 illustrates the embossing system 8 when the die 28 and counter 10 are retracted apart from each other, and FIG. 4 illustrates the embossing system 8 when the die 28 and counter 10 are pressed together to emboss the sheet 26. FIG. 5 illustrates a system 208 including the counter 10 and the male die 228 in a compressed state.

As the sheet 26 is embossed, the die 28 contacts against the sheet 26, pressing against the bumper 14 and mat 12. The resilient bumper 14 and mat 12 deform so that the mat 12 fills against contour of the die 28 and supports the sheet 26 under the embossed area. As mentioned, in an embodiment, the embossing stroke vertically compresses the mat and bumper between about 0.03 to 0.125 inch, and typically about 0.0625 inch beyond the initial contact.

An undesirable "witness mark" or "ghosting" effect can sometimes be formed on the sheet 26 where contacted by the bumper 14. The embossed sheet may sized to not contact any portion of the bumper. However, some sheets may be too large to fit on only the mat area. For example, a sheet that forms a two-panel greeting card or three-panel greeting card typically lies across an edge 50 of the bumper. In such a case, the sheet 26 is preferably positioned so that the fold line of the card is aligned over the edge 50 of the bumper 14. Also, that particular edge 50 (FIG. 1) of the bumper 14 which meets the fold line is thinner, having a narrow width (e.g., about 0.10 inch) in order to minimize the size and appearance of any resulting witness mark.

In an automated system wherein the sheets are repeatedly fed in a feed direction, it is desirable to reduce the risk of snagging. Accordingly, the end walls 22, 24 are shaped with a chamfered edge and positioned along the feeding direction.

As also illustrated in FIGS. 3 and 4, a friction-reducing film 44 is positioned between the mat 12 and the sheet 26. The film 44 reduces friction between the mat 12 and the sheet 26, thereby aiding to release the sheet 26 from the mat 12 after embossing and reducing a risk of damaging the sheet 26. The film 44 may be made of mylar, urethane, or some other suitable material. A urethane film product marketed by Astor Universal, a Markem Company, 3841 Greenway Circle, Lawrence, Kans., USA, called "CC010 Countercast Tuff Film" has been found to serve as a suitable material for the film 44. In one embodiment, the film may have a thickness of:

| | Range | Preferred |
|---|---|---|
| Thickness (inches) | .003–.090 | 0.010 |

For maintaining the film 44 in a taut position across the upper surface of the mat 12, the embossing system includes a rectangular frame 46. In a preferred embodiment, the frame 46 is shaped to extend exteriorly around the walls 18, 20, 22, 24, and at least two ends of the film 44 are secured to the frame 46 by U-shaped clips 48 adjacent to the chamfered walls 22, 24. The frame 46 is preferably made of a relatively heavy material, such as steel, so that the weight of the frame 46 holds the film 44 in place. The film 44 can be easily removed and replaced by lifting the frame 46 and removing the U-shaped clips 48. A fresh film 44 can then be mounted to the frame 46 with the clips 48 and placed over the mat 12. To further help reduce snagging, the film 44 is clipped at the two ends corresponding to the chamfered end walls 22, 24, along the sheet feeding direction.

In FIG. 3, the die 28 and press counter 10 are illustrated in a retracted or lifted position. While the die 28 is retracted, the sheet 26 is placed between the film 44 and the die 28, and the sheet 26 is positioned so that the desired area of the sheet 26 to be embossed is aligned under the die 28.

Turning to FIG. 4, the press is actuated, thereby moving the table 16 upwardly to press the sheet 26 against the die 28. The actuation pressure may vary from application to application depending on the type and thickness of the sheet material, the shape and depth of the embossment, and other factors. In general, for typical greeting card embossments, a die pressure of about 2000 psi may be suitable. In one embodiment, the pressure, dwell time and temperature for a Gietz Press or Bobst Press would be as follows:

| | First Range | Second Range | Preferred |
|---|---|---|---|
| Pressure (psi) | 1000–10,000 | 1000–5000 | 2500 |
| Dwell Time (seconds) | 0–3.0 | 0–0.8 | 0.4 |
| Temperature (Fahrenheit) | 80°–300° | 130°–210° | 165° |

Still referring to FIG. 4, when the sheet 26 is pressed by the die, the sheet 26 contacts the film 44, which in turn is pressed against the mat 12 and bumper 14, which are supported by the walls 18, 20, 22, 24 and table 16. The upper surface of the mat 12 presses upwardly against the sheet 26 (through the film 44 ), opposing the die force and complementarily deforming to the contour of the die 28. The sheet 26 is embossed between the die 28 and the mat 12 to affect the desired embossment of the sheet 26. The die 28 is subsequently retracted, and the embossed sheet 26 is removed.

Because the flexible counter 10 is resilient, the flexible counter 10 provides effective counter-support against a variety of die contours. The flexible counter 10 eliminates a need for an expensive cooperatively-shaped mating die. Accordingly, maintaining precise alignment of the flexible counter 10 relative to the die 28 is unnecessary.

While the invention is described herein in connection with certain embodiments, the invention is not limited to those embodiments. On the contrary, various changes and modifications to the described embodiments will be apparent to those skilled in the art, and such changes and modifications may be made without departing from the spirit and scope of the present invention.

What is claimed is:

1. A flexible counter for supporting a sheet when pressed by a contoured die, the counter comprising:

a resilient mat; and a bolster for supporting the resilient mat, the bolster including a table surface supporting a bottom of the mat, a plurality of walls extending peripherally around edges of the mat, and a bumper that fits between an upper portion of the walls and the mat.

2. The invention as in claim 1, wherein a portion of the bumper projects a distance from the walls.

3. The invention as in claim 2, wherein the bumper projects about 0.090 to 0.125 inch from the walls, in an uncompressed condition.

4. The invention as in claim 1, wherein, in an uncompressed condition, an upper surface of the mat is about flush with an upper surface of the bumper.

5. The invention as in claim 1, wherein each of the walls has a channel extending along an upper edge thereof to seat the bumper, the bumper fitting within the channel.

6. The invention as in claim 1, further comprising a friction-reducing film extending across the mat.

7. The invention as in claim 6, wherein the film has at least one edge mounted relative to the bolster.

8. The invention as in claim 6, further comprising a frame extending peripherally around the walls, the film being secured to at least two sides of the frame.

9. The invention as in claim 8, further comprising at least one U-shaped clip, the clip securing the film to the frame.

10. The invention as in claim 1, wherein the bumper is more rigid than the mat.

11. The invention as in claim 1, wherein the bumper is made of urethane.

12. The invention as in claim 1, wherein the mat has a generally uniform thickness.

13. The invention as in claim 1, wherein the bumper is unitary.

14. The invention as in claim 1, wherein the bumper includes a plurality of strips.

15. The invention as in claim 1, wherein each of the walls is rigidly mounted to the table, at least one of the walls having a projection and the table having at least one groove, the projection fitting within the groove.

16. The invention as in claim 1, further comprising a shim positioned between the mat and the table.

17. An embossing system for embossing cards, the system comprising:

a die having a contoured surface;

a flexible counter opposing the die and being movable relative thereto, the flexible counter including a resilient mat and a bolster for supporting the mat, the bolster having:

a table surface;

a plurality of peripheral walls fixed relative to the table, the peripheral walls extending around a side of the mat; and a bumper that fits between an upper portion of the wall and the mat.

18. The invention as in claim 17, wherein the bumper projects a distance beyond the walls, in an uncompressed condition.

19. The invention as in claim 18, wherein the bumper projects from about 0.090 to 0.125 inch from the walls.

20. The invention as in claim 17, wherein the mat has an upper surface relative to bumper such that, in an uncompressed condition, an upper surface of the mat is about flush with an upper surface of the bumper.

21. The invention as in claim 17, wherein each of the walls has a channel extending along an upper edge thereof to seat the bumper, the bumper fitting within the channels.

22. The invention as in claim 17, further comprising a friction-reducing film extending across the mat.

23. The invention as in claim 17, wherein the film has at least one edge mounted relative to the bolster.

24. The invention as in claim 17, wherein the bumper is more rigid than the mat.

25. The invention as in claim 17, wherein the bumper is made of urethane.

26. The invention as in claim 17, wherein the mat has a generally uniform thickness.

27. The invention as in claim 17, wherein the bumper is unitary.

28. The invention as in claim 17, wherein the bumper includes a plurality of strips.

29. A method of embossing a paper sheet, the method comprising the steps of:

pressing a sheet with a contoured die;

supporting a side of the sheet opposite the die with an upper side of a mat which resiliently deforms to match a contour of the die;

supporting an underside of the mat against a rigid table;

supporting peripheral sides of the mat with a resilient bumper, the bumper fitting between the mat and walls fixed to the table.

30. The invention as in claim 29, further comprising the step of contacting the die against the bumper.

31. The invention as claimed in claim 29, wherein an upper surface of the bumper is about flush with the upper surface of the mat.

32. A flexible counter for supporting a sheet when pressed by an contoured die, the counter comprising:

a resilient mat;

a bolster for supporting the resilient mat, the bolster including:

a table surface;

a shim on the table and supporting a bottom of the mat; and a plurality of walls mounted to the table and extending peripherally around edges of the mat.

33. The invention as claimed in claim 32, further comprising a bumper disposed around an upper portion of peripheral edges of the mat.

34. A flexible counter for supporting a sheet when pressed by a contoured die, the counter comprising:

a resilient mat;

a bolster for supporting the resilient mat, the bolster including:

a table surface supporting a bottom of the mat, the table having at least one groove; and a plurality of walls mounted to the table and extending peripherally around edges of the mat, at least one of the walls having a projection that fits within the groove of the table.

35. The invention as claimed in claim 34, further comprising a bumper disposed around an upper portion of peripheral edges of the mat.

* * * * *

UNITED STATES PATENT AND TRADEMARK OFFICE

CERTIFICATE OF CORRECTION

PATENT NO. : 6,349,639
DATED : February 26, 2002
INVENTOR(S) : Ronald R. Smith et al.

It is certified that error appears in the above-identified patent and that said Letters Patent is hereby corrected as shown below:

Column 2,
Line 67 "bolsterz" should read -- bolster --.

Signed and Sealed this

Twenty-first Day of May, 2002

*Attest:*

*Attesting Officer*

JAMES E. ROGAN
*Director of the United States Patent and Trademark Office*